US012419427B1

(12) United States Patent
Grimm

(10) Patent No.: US 12,419,427 B1
(45) Date of Patent: Sep. 23, 2025

(54) PORTABLE HEADREST AND SLEEPING APPARATUS

(71) Applicant: Erick Stephen Grimm, Batavia, OH (US)

(72) Inventor: Erick Stephen Grimm, Batavia, OH (US)

( * ) Notice: Subject to any disclaimer, the term of this patent is extended or adjusted under 35 U.S.C. 154(b) by 0 days.

(21) Appl. No.: 18/744,967

(22) Filed: Jun. 17, 2024

(51) Int. Cl.
*A47C 16/00* (2006.01)

(52) U.S. Cl.
CPC ..... *A47C 16/00* (2013.01)

(58) Field of Classification Search
CPC ..... A47C 16/00
USPC ..... 248/118, 118.5
See application file for complete search history.

(56) References Cited

U.S. PATENT DOCUMENTS

| | | | | |
|---|---|---|---|---|
| 3,042,940 | A | 7/1962 | Keaton | |
| 4,458,784 | A * | 7/1984 | Holmes, Jr. | A01D 46/243 182/230 |
| 5,232,543 | A | 8/1993 | Frelich | |
| 5,695,242 | A | 12/1997 | Brantman | |
| 5,979,975 | A | 11/1999 | Hiraoka | |
| 7,036,168 | B1 * | 5/2006 | Knickerbocker | A61G 13/12 5/636 |
| 7,393,057 | B2 * | 7/2008 | Fraser | B60N 2/885 297/392 |
| 7,395,566 | B2 | 7/2008 | Hetzel | |
| 7,717,520 | B2 | 5/2010 | Boren | |
| 8,678,505 | B2 | 3/2014 | Kanda | |
| 8,696,059 | B2 | 4/2014 | Carmichael | |
| 9,498,056 | B1 | 11/2016 | Mills | |
| 9,573,502 | B2 | 2/2017 | Seki | |
| 9,635,897 | B2 | 5/2017 | Prust | |
| 9,656,581 | B2 * | 5/2017 | Brecht | B60N 2/856 |
| D803,610 | S | 11/2017 | Jackow | |
| D808,192 | S | 1/2018 | Schumacher | |
| 9,993,084 | B2 | 6/2018 | Trucco | |
| 10,001,246 | B2 * | 6/2018 | Sitzmann | F16M 11/2021 |
| 10,159,354 | B2 | 12/2018 | Rayburn | |
| 10,172,468 | B2 * | 1/2019 | Houghson | F16M 11/28 |
| 10,178,914 | B2 | 1/2019 | Trucco | |
| D841,362 | S | 2/2019 | Vance | |
| 10,231,549 | B2 | 3/2019 | Johnson | |
| 10,980,349 | B2 | 4/2021 | Miller | |
| 11,102,957 | B2 * | 8/2021 | Lee | A61D 3/00 |
| 11,213,144 | B2 | 1/2022 | Eid | |
| 11,737,570 | B2 | 8/2023 | Stune | |
| 11,944,209 | B1 * | 4/2024 | Byrne | A47C 7/383 |
| 2002/0100846 | A1 * | 8/2002 | Tinsley | A61G 13/12 248/118 |
| 2003/0084513 | A1 * | 5/2003 | Splane, Jr. | A47C 16/00 5/652 |
| 2012/0248839 | A1 | 10/2012 | Fujita | |
| 2013/0232696 | A1 * | 9/2013 | Halimi | A47C 16/00 5/640 |
| 2014/0015234 | A1 | 1/2014 | Nukaya | |
| 2014/0033439 | A1 * | 2/2014 | Berhanu | A47C 16/00 5/640 |

(Continued)

*Primary Examiner* — Muhammad Ijaz
(74) *Attorney, Agent, or Firm* — Mark F. Smith; Smith Brandenburg Ltd

(57) ABSTRACT

The subject invention is a headrest and sleeping apparatus having a specific structure to allow for an individual, while seated, to lean forward and rest the individual's head on a cushion that can be adjusted to place the cushion in a desired position.

16 Claims, 19 Drawing Sheets

(56) References Cited

U.S. PATENT DOCUMENTS

| | | | | |
|---|---|---|---|---|
| 2014/0312186 | A1* | 10/2014 | Mech | A47C 20/026 248/118 |
| 2014/0346316 | A1* | 11/2014 | Sitzmann | A47C 16/00 248/688 |
| 2015/0001905 | A1* | 1/2015 | Jackow | B60N 2/806 297/397 |
| 2015/0107025 | A1 | 4/2015 | Daupjin | |
| 2017/0055714 | A1 | 3/2017 | Mills | |
| 2017/0354263 | A1* | 12/2017 | Houghson | A47C 7/383 |
| 2018/0084919 | A1* | 3/2018 | Rayburn | A47C 7/383 |
| 2021/0378406 | A1* | 12/2021 | Broyles | F16M 11/242 |
| 2023/0057611 | A1 | 2/2023 | Olson | |
| 2023/0193515 | A1* | 6/2023 | Realyvazquez Guevara | B64D 11/00 442/123 |

* cited by examiner 152
100
104
150
158
102
10
16

PORTABLE HEADREST AND SLEEPING APPARATUS

BACKGROUND OF THE INVENTION

The present application claims benefit to and incorporates in its entirety by reference the subject matter contained in U.S. provisional patent application No. 63/494,016 filed on Apr. 4, 2023, titled: Head Resting Assembly.

The invention relates generally to a resting device. More particularly, the invention relates to a portable resting and sleeping apparatus having a specific structure to allow for an individual to rest their head while seated.

Currently there are a number of portable apparatus for allowing an individual to rest his/her head while traveling. One such apparatus is shown and disclosed in U.S. Pat. No. 9,498,056. The apparatus includes two telescoping legs having two longitudinal rotating leg anchors. A pillow is pivotably connected to the upper portion of the legs, which can be adjusted to place the pillow at a desired height and the pillow can be pivoted to place the pillow in a desired angle for use. One problem with such an apparatus is that the leg anchors rests on the user's legs which can cause the anchors to move with small movements of the user's legs, thus moving the position of the pillow that can cause the user's rest to be disturbed. Further, the leg anchors press against the user's legs which can become uncomfortable over time, such as during a long travel time. In addition, such leg anchors make resting the apparatus on a surface, such as a seat tray or placement between a user's legs for resting on the seat, relatively difficult or unable to be easily performed.

Another such apparatus is shown and disclosed in U.S. Pat. No. 9,656,581. The apparatus is a support apparatus having a base, a support post, a housing and a headrest cushion. In its deployed position, the support is configured to be placed upon or secured to an armrest of a seat and the user bends his head in the direction of the armrest such that the side of the user's head (right or left side) rests against the cushion. While such a headrest may be comfortable for short periods of time, it can be uncomfortable and may result in a "stiff" neck if used for any substantial length of time, such as travel times of 30 minutes or more. Further, the apparatus cannot be supported on a tray, or on or between the user's legs or supported on the floor. In addition, larger users may tend to have a portion of the user's body encroach into another person's space, such as the person sitting next to the user, that can disturb the other person's space.

Another portable headrest is shown and described in U.S. Pat. No. 10,159,354 having a support attached to a base at one end and attached to a frame at its other end. Two arms support a pillow. The base can rest on a surface in front of the user such as a tray mounted to the rear of a seat in front of the user. An extender may be used to adjust the length of the support. While such a headrest allows a user to adjust the length of the support by adding or subtracting pre-sized extenders, the user is unable to precisely adjust the length, thus the position of the pillow. Further, the support extends outwardly from the base at a predefined angle, thereby requiring the user to lean forward which for certain users may be uncomfortable and may result in a "stiff" back after prolong use of the apparatus. It also does not appear that the pillow can be pivoted into a desired position. Further, the base of the headrest cannot be comfortably positioned to rest on or below the user's legs.

Another apparatus for supporting a user in a forward-leaning position is shown and described in U.S. Pat. No. 11,737,570. The apparatus includes a faceplate, an arm attached to the faceplate and a base. The faceplate can be pivotably adjusted and the arm can be adjusted to set the height of the faceplate. A hook can be attached to the base to engage the edge of a working surface, such as a tray, to prevent the base from sliding away from the user during use. Coupled to the arm is a chest support cushion to support the user's sternum during use. As shown, the apparatus is that the arm extends from the base in a direction away from the user to allow the chest support cushion to be properly positioned for support the user's sternum during use. Unfortunately, extending the arm in a direction such that it is the direction away from the user may limit the height adjustment of the arm and often makes it difficult to use when the distance between the seat in front of the user is somewhat narrow. This is particular troublesome now that many airlines are reducing the seat distance. Further, the full weight of support the user's head is not transmitted directly through the arm to the base and the support structure (tray) but is applied to the attachment or arm pivoting apparatus, thereby increasing the stress on the parts that can result in deterioration of the parts over time.

According, it is desirable to have a headrest and sleeping apparatus that has relatively few components thereby making the headrest and sleeping apparatus relatively light weight and inexpensive to manufacture, that can be easily carried and stored, that can be easily set-up for use, that can be placed on various support surfaces, such as a tray, seat or floor, that can be adjusted to properly position the cushion for use by the user, that does not result or reduces neck and/or back pain, that can be used with reduced spacing between the user's seat and the seat in front of the user, and is designed to minimize wear and tear of the components. Therefore, there currently exists a need in the market for an apparatus that is sleek, ergonomic, portable and can provide full head support allowing a user to rest and sleep during travel and can also be used to provide both head support and leg restraint during use.

SUMMARY OF THE INVENTION

The headrest and sleeping apparatus of the subject invention is provided in an assembly that allows for support of the head of the user when the user is in a sitting position, for example during traveling.

The headrest and sleeping apparatus preferably is in size and parts designed according to the TSA carry-on regulations.

A preferred embodiment of the headrest and sleeping apparatus for use by a user comprises a base having an upper surface and a lower surface and the base is pivotally coupled to a basket having an opening; a cushion support having an upper surface and a lower surface and a bracket with an inner bore coupled to the lower surface of the cushion support; a telescoping tubular shaft having a downward end freely set within the opening of the basket and having an upward end positioned within the inner bore of the bracket; and a cushion positioned along the upper surface of the cushion support.

In a preferred embodiment of the invention the base has a downwardly extending lip.

In a preferred embodiment of the invention the headrest and sleeping apparatus further comprises a surface material pad attached to the lower surface of the base.

In a preferred embodiment of the invention the base includes a base extender.

In a preferred embodiment of the invention the telescoping tubular shaft is attached to a tubular extender.

In a preferred embodiment of the invention the cushion has an upper surface and a removable washable cloth covering the upper surface of the cushion.

In a preferred embodiment of the invention the cushion has an upper surface and a removable washable, antimicrobial cloth covering the upper surface of the cushion.

In a preferred embodiment of the invention the length of the telescoping tubular shaft is fully adjustable and maintained in length from a minimum tubular length to a maximum tubular length and to any intermediate tubular length.

Another preferred embodiment of the invention, the headrest and sleeping apparatus comprises a base having an upper surface and a lower surface and the base is pivotally coupled to a basket having an opening; a cushion support having an upper surface and a lower surface and a bracket with an inner bore coupled to the lower surface of the cushion support; a telescoping tubular shaft having a downward end freely set within the opening of the basket and having an upward end positioned within the inner bore of the bracket; and a cushion positioned along the upper surface of the cushion support; wherein the length of the telescoping tubular shaft is fully adjustable and maintained in length from a minimum tubular length to a maximum tubular length and to any intermediate tubular length; and wherein the base has a position securing device for maintaining the base in position of the support surface.

In a preferred embodiment of the invention the position securing device is a downwardly extending lip.

In a preferred embodiment of the invention the position securing device is a surface material pad attached to the lower surface of the base.

These and other benefits, advantages, and embodiments of the invention will be apparent from the following description, the accompanying drawings and the appended claims.

BRIEF DESCRIPTION OF THE DRAWINGS

Features, aspects, and advantages of the present invention will become better understood with regard to the following description, appended claims, and accompanying drawings where:

DETAILED DESCRIPTION OF THE INVENTION

Figure 1:
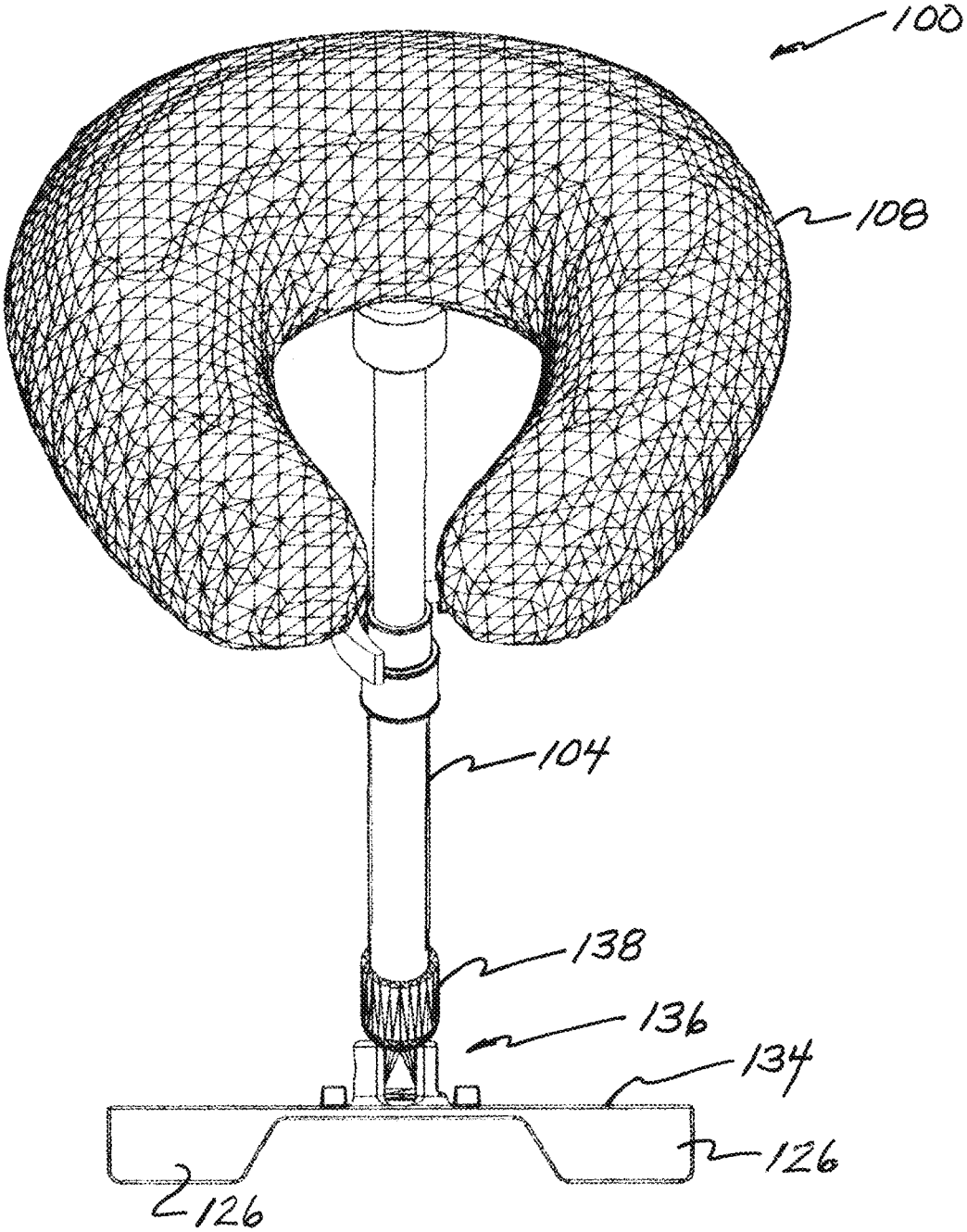
FIG. 1 is a forward-looking front schematic perspective illustration showing an exemplary embodiment of the headrest and sleeping apparatus with a base having a general rectangular shape, a telescoping tubular shaft and a cushion for supporting the head of a user.

The subject invention is a portable headrest and sleeping apparatus for providing a comfortable device for allowing a user to rest while seated. The headrest and sleeping apparatus permits the user to rest in a forward-leaning position to allow the user to rest the user's head during periods of travel. The headrest and sleeping apparatus can most generally be adapted to provide natural support to the head of a user and is provided in a structure and materials that can be considered durable and easy to transport, store and assemble.

As used herein the terms "downward" or "downwardly" refer to the direction towards the ground or the surface that the headrest and sleeping apparatus is supported on during use (support surface). The term "generally perpendicular" refers to the angle of about 45 degrees to 90 degrees. The terms "upper," "upward" or "upwardly" refer to the direction away from the ground or the surface that the headrests and sleeping apparatus rest on during use (support surface). The term "lower" refers to the direction towards the ground or the surface that the headrest and sleeping apparatus rests on during use (support surface). The term "vertical" refers to the direction generally perpendicular to the ground or the surface that the headrests and sleeping apparatus rest on during use (support surface) and the term "horizontal" refers to the direction parallel to the ground or the surface that the headrest and sleeping apparatus is support on during use (support surface). The term "forward" or "forwardly" refers to the direction towards the user during use and the terms "backward" or "backwardly" refer to the direction away from the user during use. The term "rear" refers to a position farthest away from the user during use. The terms "pivot," "pivoting" and "pivotably" refers to swiveling or swinging along the vertical axis. The terms "rotate," "rotating" and "rotatable" refers to swiveling or swinging along the horizontal axis. In describing the preferred embodiments of the invention illustrated in the drawings, specific terminology will be resorted to for the sake of clarity. However, the invention is not intended to be limited to the specific terms so selected, and it is to be understood that each specific term includes all technical equivalents that operate in a similar manner to accomplish a similar purpose. Examples of specific implementations and applications are provided primarily for illustrative purposes.

Figure 5:
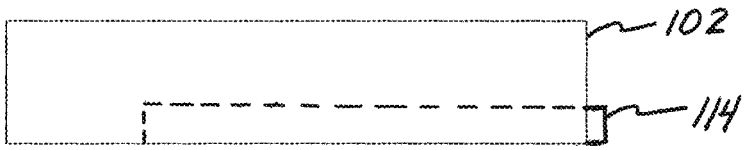
FIG. 5 is a schematic illustration showing the base having a base extender nested within the base.
Figure 6:
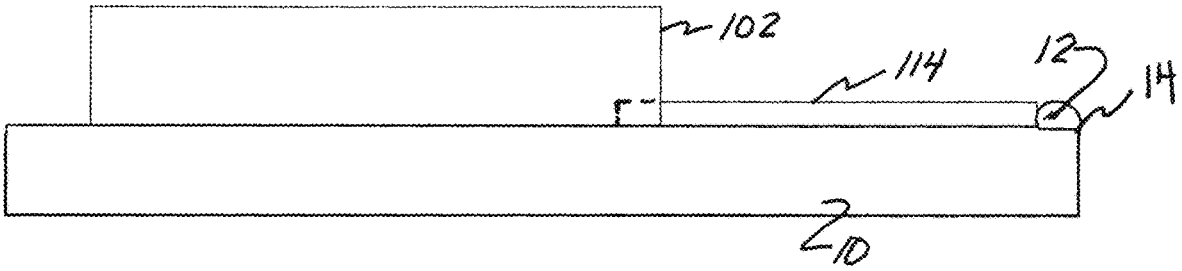
FIG. 6 is a schematic illustration showing the base extender extending outwardly from the base for resting along an upwardly extending ridge on the support surface.

Referring to FIGS. 1-4, the headrest and sleeping apparatus 100 of the subject invention is shown broadly comprises a base 102, a telescoping tubular shaft 104, a cushion support 106 (FIG. 13) and a cushion 108 that together provide a comfortable head support for a user. The headrest and sleeping apparatus preferably is sized and the components (parts) are designed according to the TSA carry-on regulations. The base 102, is a geometrically shaped pad, such as for a non-limiting example a generally rectangular or triangular shape. In a preferred embodiment, as illustrated in FIG. 1, the base 102 has a generally rectangular shape with a rearward longitudinally extending side 110, a forward triangular shaped longitudinally extending side 111 and two opposed parallel traversing sides 112 for resting on a support surface 10, such as a tray, a floor, a lower seat portion, or the user's thighs. Preferably, the base 102 is sized to fit on a support surface such as a typically tray mounted to the rear of a seat in front of the user, for example trays found in passenger aircraft, and preferably it can be extended to fit comfortably on the thighs of the user or between a seat cushion and the thighs of the user. In a preferred embodiment, as illustrated in FIGS. 5 and 6, the base 102 includes a base extender 114 that in a compressed state is nested within the base 102 (FIG. 5) and in an extended state the base extender 114 extends outwardly from a side of the base 102 (FIG. 6) thereby allowing the base 102 to rest along an upwardly extending ridge 12 often positioned along the periphery 14 of the support surface 10 (tray) or on the thighs of the user or between the thighs of the user and a seat cushion that the user is sitting on thereby preventing or reducing the likelihood that the base will slide off the tray or seat during use.

Figure 2:
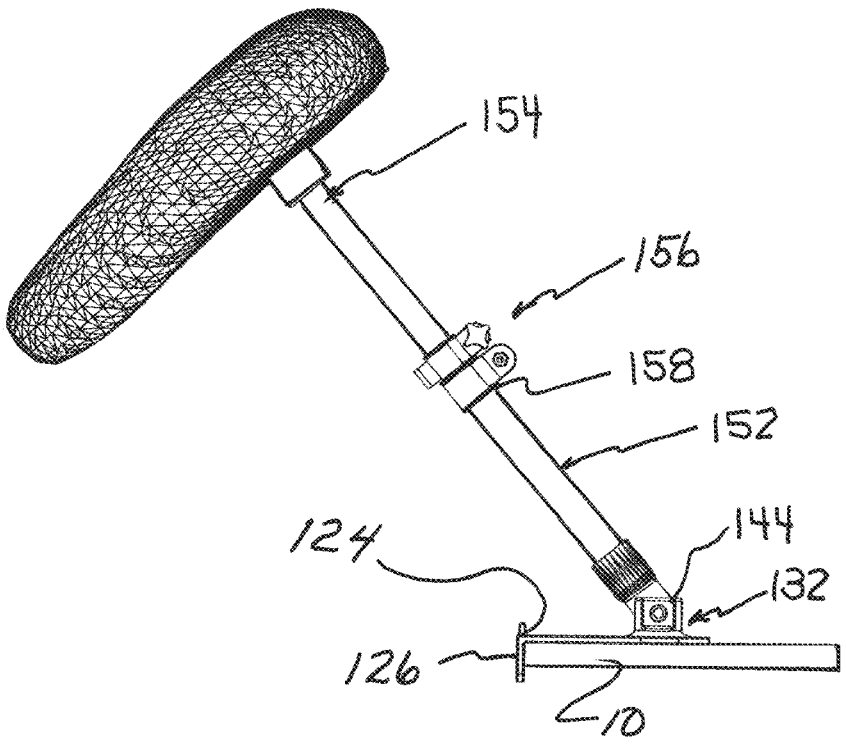
FIG. 2 is a side schematic perspective illustration showing an exemplary embodiment of the headrest and sleeping apparatus showing the telescoping tubular shaft having a lower portion and an upper portion such that the upper portion is able to telescope with the lower portion to adjust the length of the telescoping tubular shaft.
Figure 3:
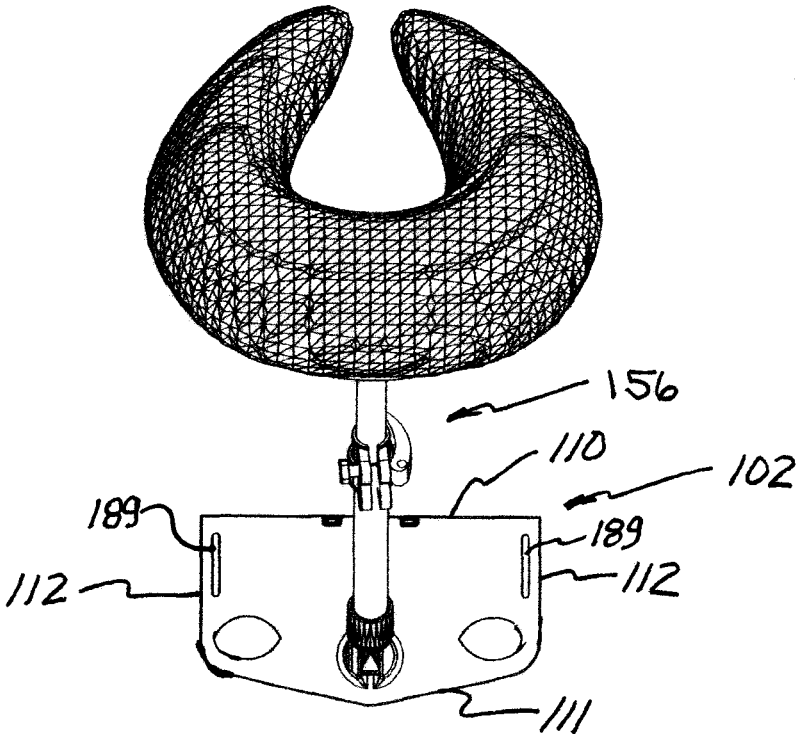
FIG. 3 is a top rearward looking schematic perspective view showing the headrest and sleeping apparatus with a locking mechanism for maintaining the telescoping tubular shaft in a desired length.
Figure 4:
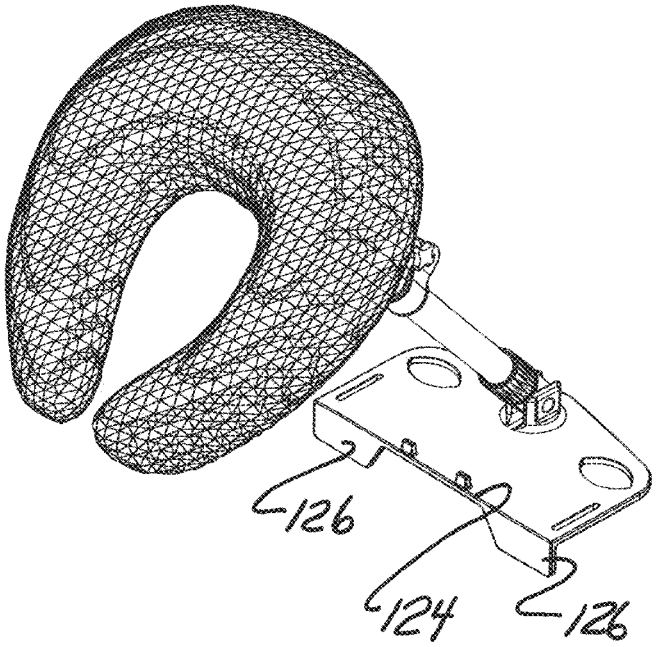
FIG. 4 is a side schematic perspective view showing the headrest and sleeping apparatus and the telescoping tubular shaft positioned within a bucket that coupled to the base by a hinge assembly bracket.

Referring to FIGS. 1 and 2, in another preferred embodiment, extending downwardly along the periphery 124 (or a portion of the periphery) from the rearward longitudinally extending side 110 is one or more vertically downwardly extending lip(s) 126. When the headrest and sleeping apparatus 100 is in use and positioned on a support surface 10, such as a tray mounted to the rear of a seat in front of the user typically found in passenger aircraft, the vertically downwardly extending lip 126 engages with the side of the tray (support surface) thereby preventing or reducing the likelihood that the base will slide off the tray during use.

Figure 7:
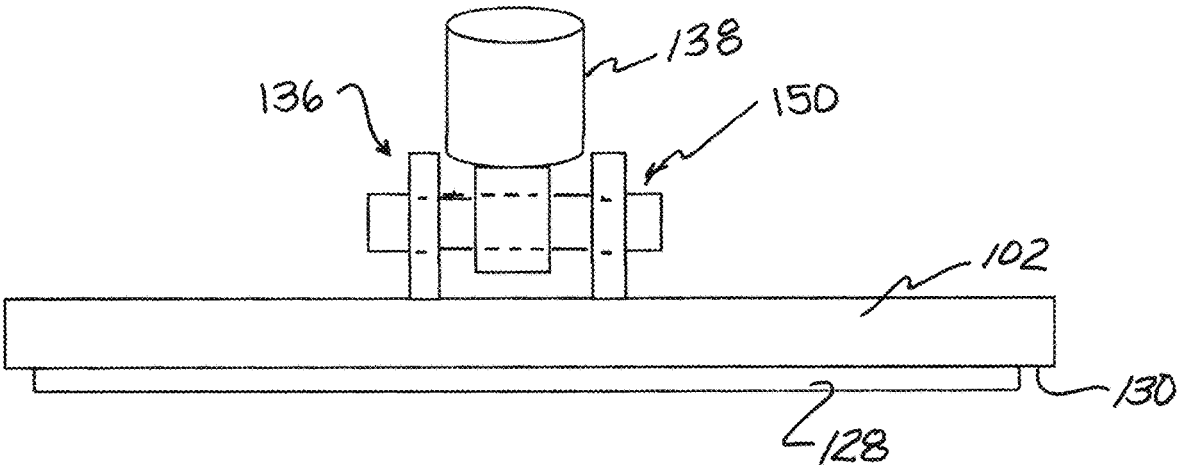
FIG. 7 is a schematic perspective illustration showing the base having a hinge assembly pivotally coupled to a bucket with a surface material pad removably attached to the lower surface of the base.
Figure 15:
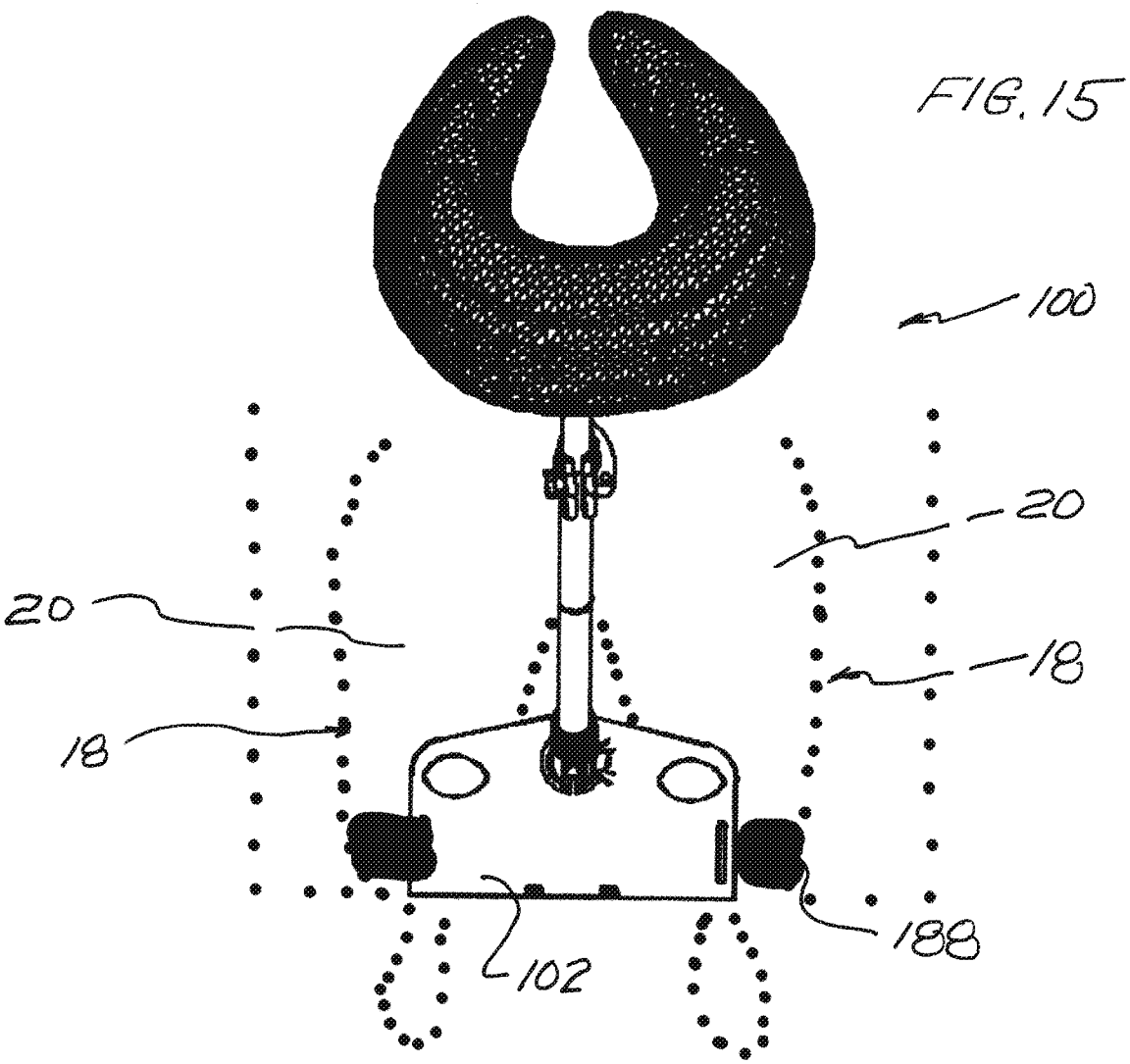
FIG. 15 is a schematic illustration showing the base resting on the user's thighs.

Referring to FIG. 7, in a preferred embodiment, the base 102 includes a rubber, plastic, or other surface material pad 128 attached to the lower surface 130 of the base 102 that increases surface friction for reducing the tendency of the base 102 sliding along the support surface 10 during use. Preferably, the surface material pad 128 is removably attached to the lower surface 130 of the base 102, such as by use of a releasable adhesive, hook and loop attachment system, or other attachment devices for allowing the surface material pad 128 to be attached and removed from the lower surface 130 of the base 102. In another preferred embodiment, the surface material pad 128 is formed from a padded material, such that when the base 102 is positioned on the upper thighs of the user during use and provides comfort for the user and helps with the stability of the portable headrest 102 (FIGS. 7 and 15).

Figure 8:
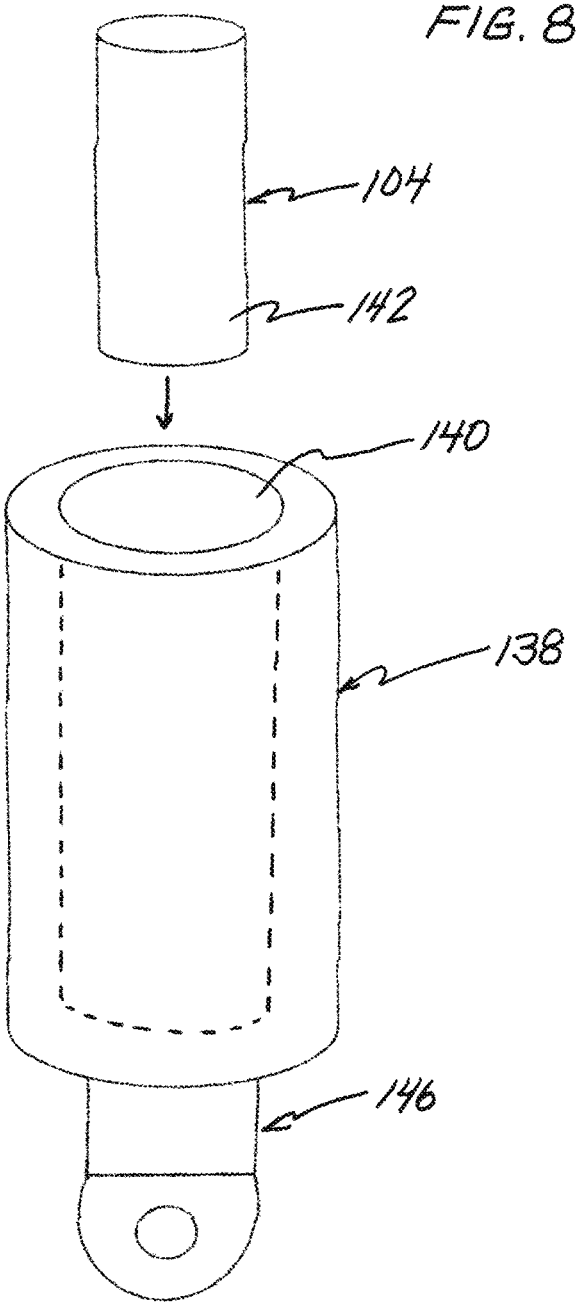
FIG. 8 is a schematic illustration showing the bucket having an opening for receiving the downward end of the telescoping tubular shaft or a tubular extender.

As illustrated in FIGS. 1 and 8, pivotally mounted along the rear periphery 132 of the upper surface 134 of the base 102 by a hinge assembly 136 is a bucket 138 having an opening 140 for receiving the downward end 142 of a tubular telescoping shaft 104. As illustrated, the hinge assembly 136 has a bracket 144 for receiving the downward end 146 of the bucket 138 and is configured to allow the bucket 138 to pivot about a vertical axis 148 between a horizontal position to a vertical position to place the telescoping tubular shaft 104 into a desired angle for use of the headrest and sleeping apparatus 100 by the user. In a preferred embodiment the bucket 138 is securely coupled to the hinge assembly 136 by a conventional fastener 150 (FIG. 7), such as a pin, and may include a conventional locking mechanism (not shown) for securing the bucket 138 and the tubular telescoping shaft 104 in a desired angle. As shown, the downward end 142 of the telescoping tubular shaft 104 is freely nested within the opening of the bucket 138 thereby allowing the telescoping tubular shaft 104 to pivot into a desired angle for use of the headrest and sleeping apparatus 100 by the user.

As illustrated in FIG. 2, the telescoping tubular shaft 104 includes a lower portion 152 and an upper portion 154 having a diameter smaller than the diameter of the lower portion 152 such that the upper portion 154 is able to telescope with the lower portion 152 so that upper portion 154 can slide relative to the lower portion 152 to adjust the length of the telescoping tubular shaft 104. A conventional locking mechanism 156, such as a clamp, is provided at the upper end 158 of the lower portion 152 for locking the upper portion 154 in place relative to the lower portion 152. It should be understood that using a locking mechanism, such as for a non-limiting example a compression clamp or a twist-type clamp, allows the tubular telescoping shaft to be adjusted from a minimum length tubular length to a maximum tubular length or to any intermediate tubular length as desired by the user.

Figure 9:
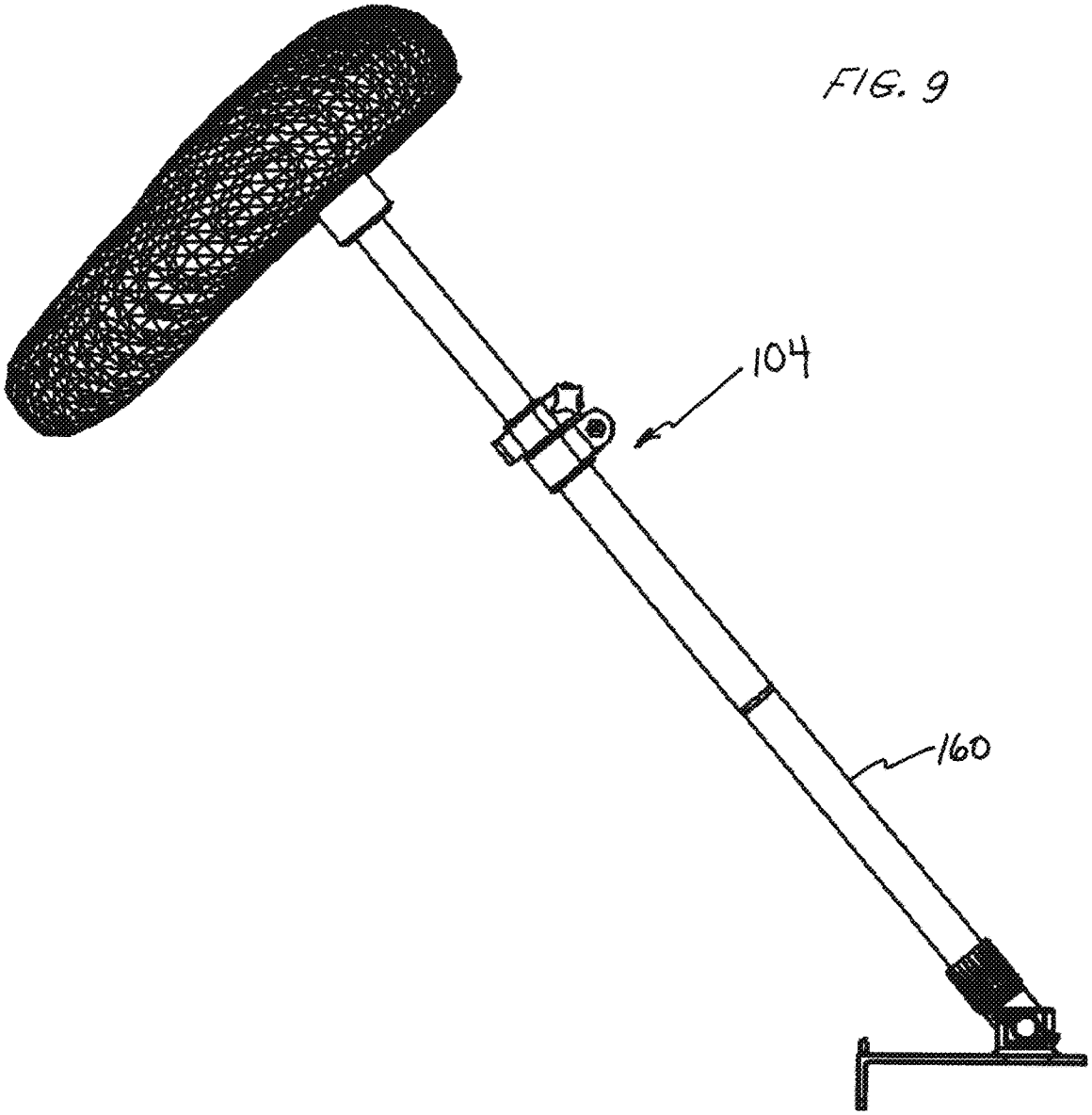
FIG. 9 is a schematic perspective illustration showing the telescoping tubular shaft in its extended configuration and attached to a tubular extender positioned within the bucket.
Figure 10:
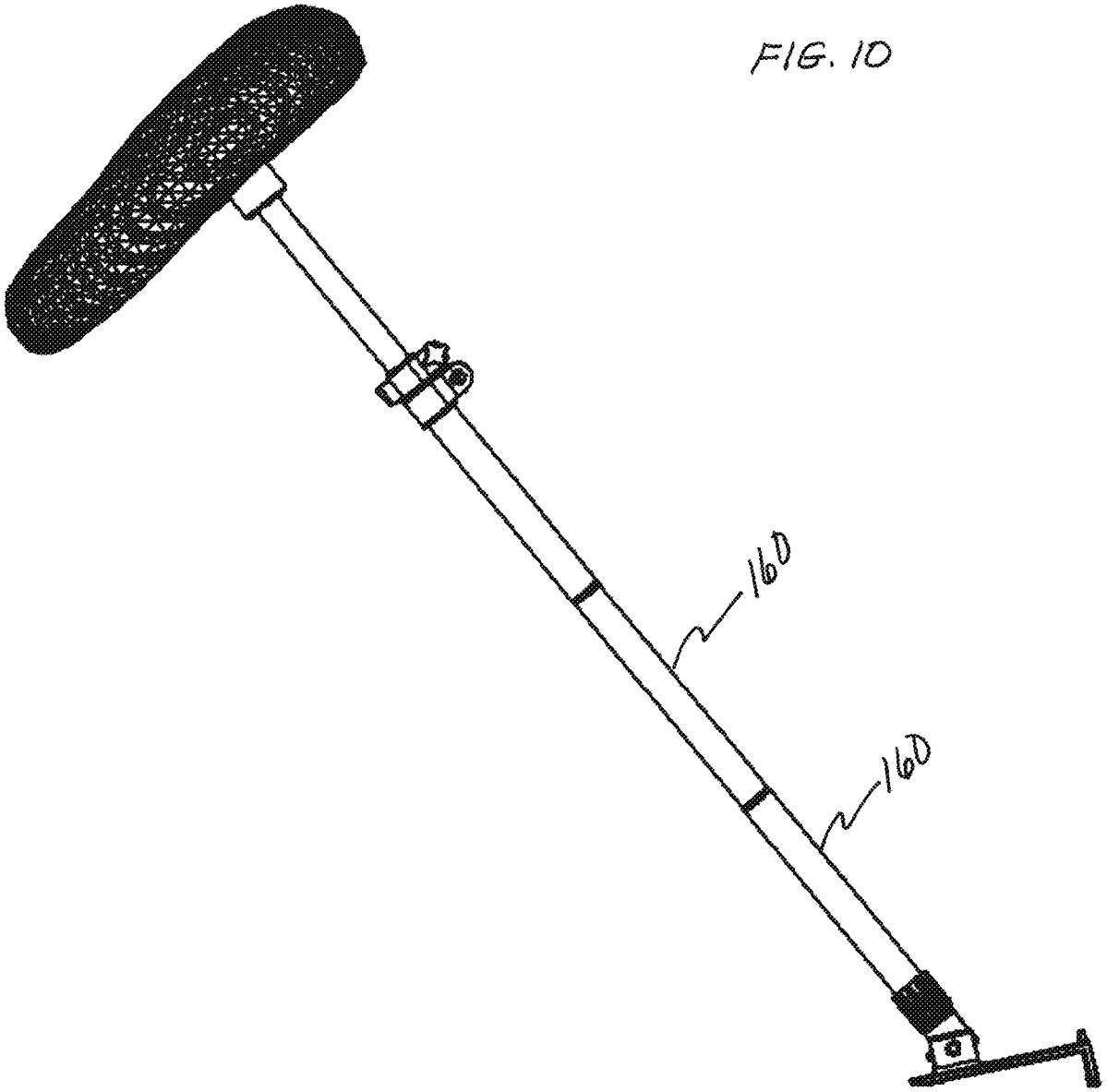
FIG. 10 is a schematic perspective illustration showing the telescoping tubular shaft in its extended configuration and having two tubular extenders.
Figure 11:
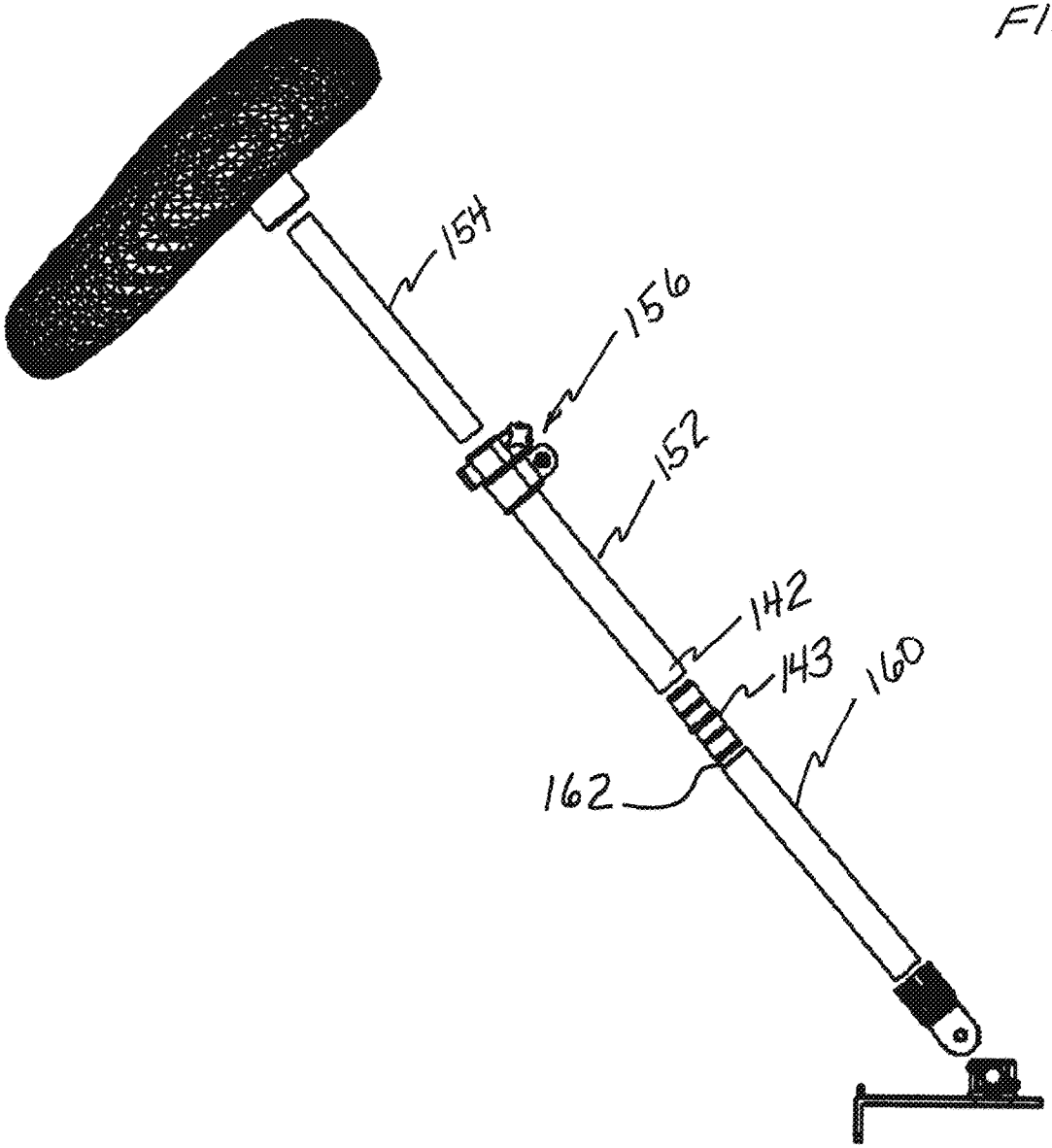
FIG. 11 is a schematic perspective exploded illustration showing the telescoping tubular shaft connected to a tubular extender by a connector.
Figure 12:
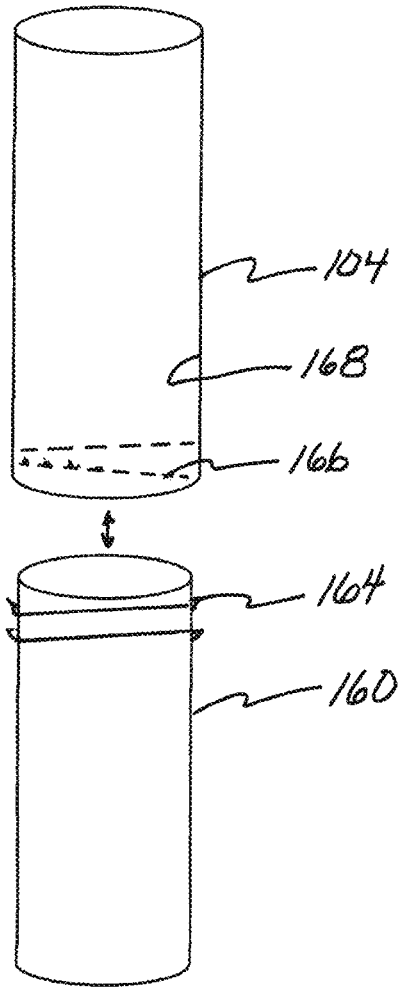
FIG. 12 is a schematic perspective illustration showing the tubular extender having screw threads that mate with corresponding screw threads of the telescoping tubular shaft.

As illustrated in FIGS. 9-11, in a preferred embodiment of the headrest and sleeping apparatus, the downward end 142 (FIG. 11) of the telescoping tubular shaft 104 is adapted to attach to one end of a tubular extender 160. In a preferred embodiment, the tubular extender 160 and the telescoping tubular shaft (or connected to another tubular extender) using a connector 143 that has a diameter smaller than the diameter of the telescoping tubular shaft 104 and the tubular extender 160 such that the connector 143 is partially inserted and nested within the upper end 162 of the tubular extender 160 and held in place by a frictional fit and a portion of the connector 143 is inserted and nested within the downward end 142 of the telescoping tubular shaft 104 and held in place by a frictional fit thereby removably coupling the tubular connector 160 and the telescoping tubular shaft 104 together. In another preferred embodiment, as illustrated in FIG. 12, the tubular extender 160 has outwardly projecting screw threads 164 that operate to mate with corresponding inwardly projecting screw threads 166 positioned along the inner surface 168 of the telescoping tubular shaft 104 for releasably securing the tubular extender 160 to the telescoping tubular shaft 104. It should now be understood that the projecting screw threads of the tubular extender can be outwardly projecting screw threads or inwardly projecting screw threads that mate with corresponding inwardly projecting screw threads or outwardly projecting screw threads of positioned along the inner surface of the telescoping tubular shaft, respectively. In another preferred embodiment, the extender(s) are coupled together and/or coupled to the downward end 142 of the telescoping tubular shaft 104 and a connector 143 that is inserted into the connecting ends and forms a frictional fit with the tubular extender(s) and the telescoping tubular shaft. Accordingly, the telescoping tubular shaft and the extender(s) are securely connected together during use and can be disconnected after use by pulling them apart. It should also be understood that various size tubular extenders can be used for achieving the desired length of the telescoping tubular shaft (FIG. 11).

Figure 13:
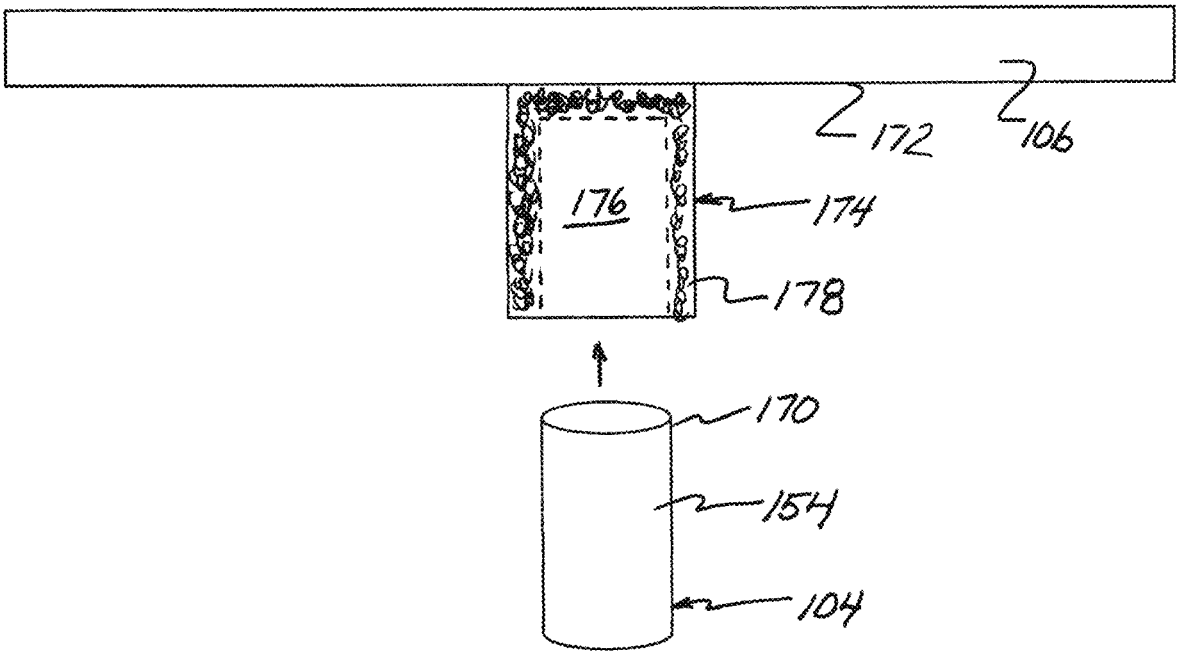
FIG. 13 is a schematic illustration showing the upper portion of the telescoping tubular shaft rotatably attached to the cushion support by a bracket.

Referring to FIG. 13, the upper end 170 of the upper portion 154 of the telescoping tubular shaft 104 is coupled to a lower surface 172 of a cushion support 106 by a cushion support bracket 174 having an inner bore 176 sized to receive the upper end 170 of the upper portion 154 of the telescoping tubular shaft 104. The cushion support bracket can be formed integral with the cushion support or can be attached by glue, screws or other suitable connection means. In a preferred embodiment, the inner bore 176 includes a bushing 178, such as formed from rubber, plastic or another similar durable elastic material, that provides a friction fit connection and reduces potential vibration being transmitted to the cushion support 106 to a cushion 108 for supporting a user's head during use of the headrest and sleeping apparatus 100. The cushion support bracket 174 having an inner bore 176 for receiving the upper end 170 of the upper portion 154 of the telescoping tubular shaft 104 allows the cushion support bracket 174 to rotate and place the cushion 108 into a desired position for use by the user. It should be understood that the bushing 178 provides resistance to rotating the cushion support 106 while also allowing a user to rotate the cushion support 106 to rotate the cushion 108 as desired.

Figure 14:
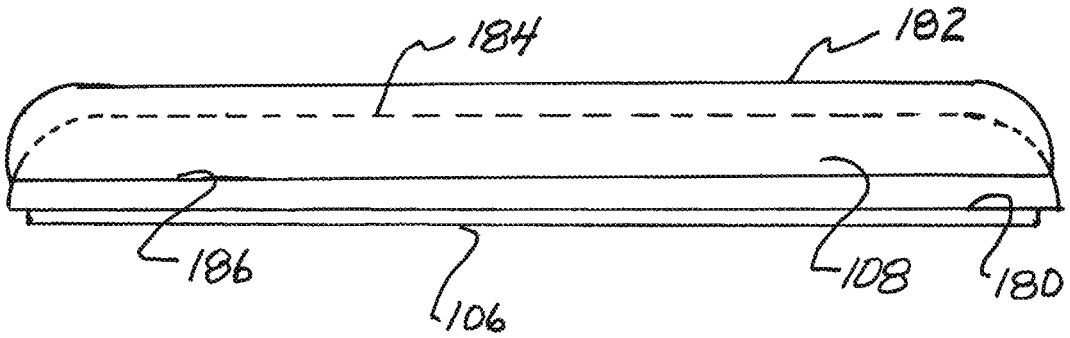
FIG. 14 is a schematic illustration showing the cushion having a cover.

Referring to FIG. 14, the cushion 108 is shown attached to the upper surface 180 of the cushion support 106. The cushion 108 has a removable cloth covering 182 having a shape that is complimentary to the shape of the upper outer surface 184 of the cushion 108. Positioned along the periphery of the cloth covering 182 is an elastic band 186 that maintains the cloth covering 182 in position covering the upper outer surface 184 of the cushion 108. Preferably, the cloth covering is a washable, antimicrobial cloth, such as, but not limited to cloths having a silver ion coating or are silver infused, cloths treated with quaternary ammonium, clothes treated with triclosan, and other cloths treated with conventional antimicrobial agents.

Referring to FIG. 15, an illustrative example of use of the headrest and sleeping apparatus 100 is shown whereby the support surface 10 for the base 102 is the upper thighs of the user sitting on a seat 16, such as a car seat or aircraft passenger seat. In a preferred embodiment, a flexible strap 188 is removably coupled at its ends to the base 102, such as through openings 189 (FIG. 3), and is sized and configured to extend around the legs 18 of the user so that when the base is positioned on the upper thighs 20 of the user and the flexible strap is extended around the user's legs, the flexible strap prevents the user's legs to move farther apart thereby allowing the base to move its position or fall off the user's thighs and disturbing the user's rest or sleep.

Figure 16:
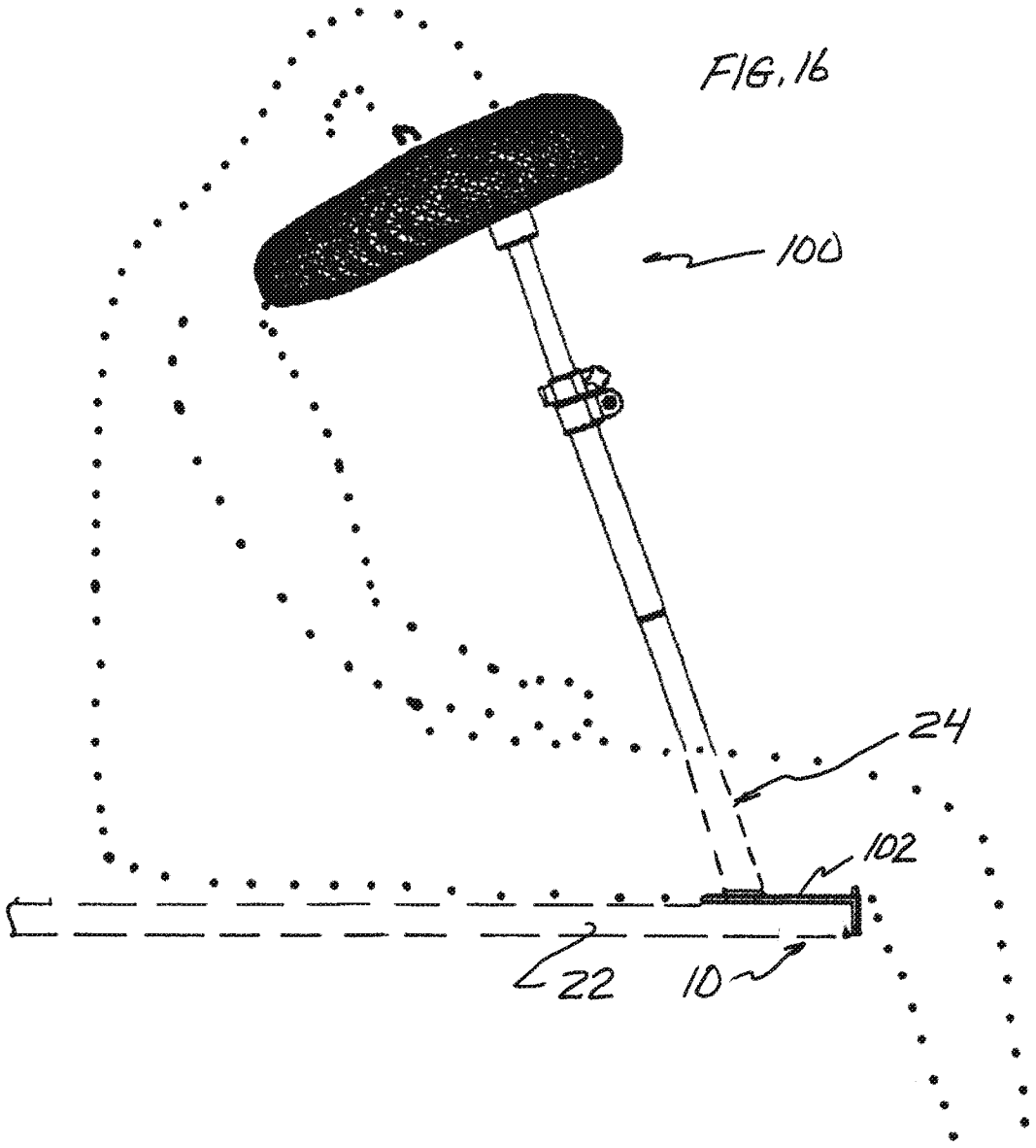
FIG. 16 is a schematic illustration showing the base resting between the thighs of the user and the seat.

Referring to FIG. 16, another illustrative example of use if the headrest and sleeping apparatus 100 is shown whereby the support surface 10 for the base is the seat cushion 22 of a seat 16 and the user's lower thighs 24 are positioned above the base 102 thereby securing the base 102 in position on the seat cushion 22. During use, the user, as described above, extends the flexible strap 188 such that it extends around the user's legs thereby preventing the user's legs from moving farther apart such that the base is maintained in position during use. It should also be understood that the use of the flexible strap operates to maintain the base in position during use when the base is resting on the user's thighs or between the user's legs, but also keeps the user's legs from infringing the leg space of others sitting next to the user.

Figure 17:
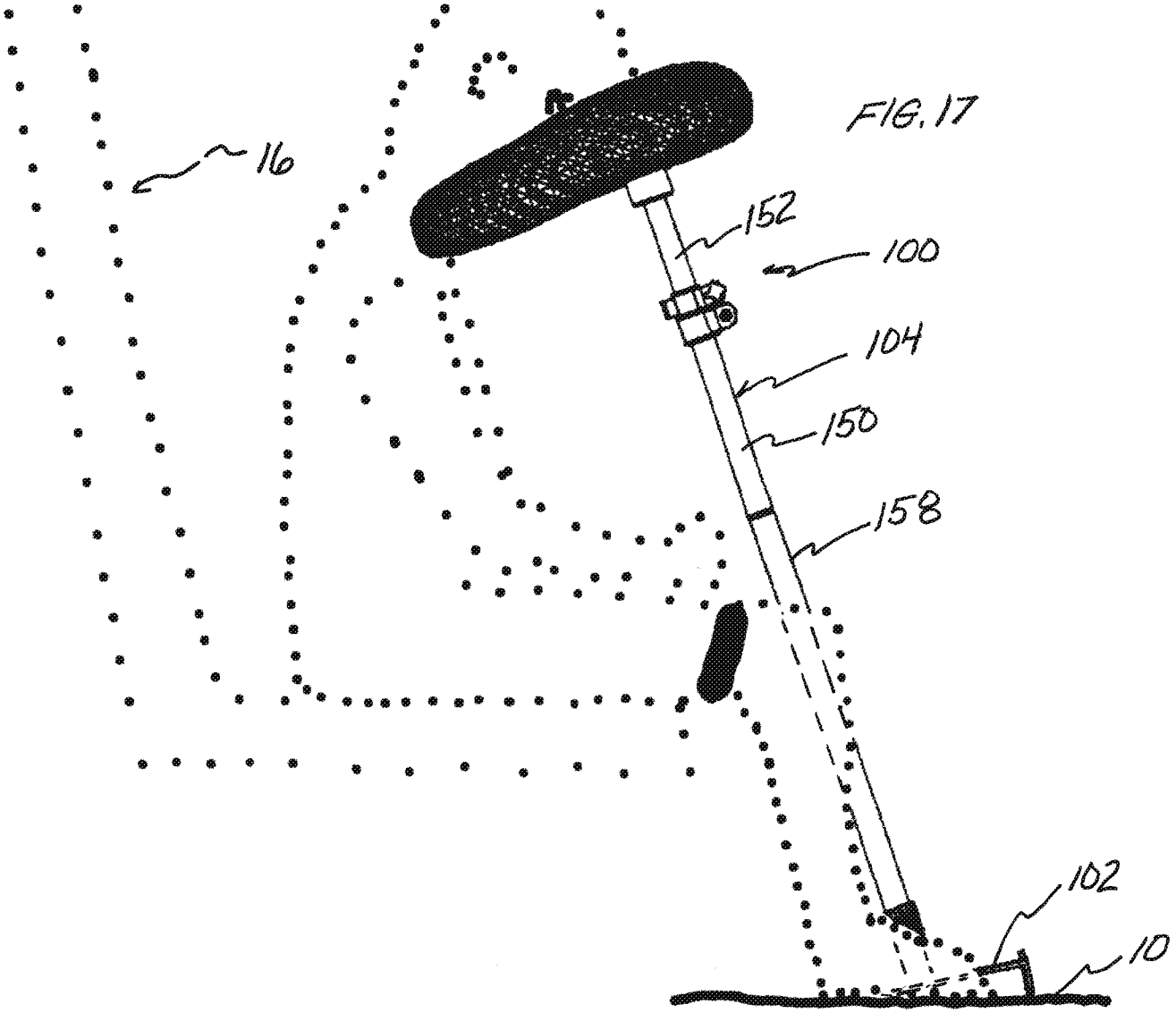
FIG. 17 is a schematic illustration showing the base resting on the floor.

Referring to FIG. 17, another illustrative example of use of the headrest and sleeping apparatus 100 is shown whereby the support surface 10 for the base 102 is the floor immediately forward of the seat being used by the user. As illustrated, the telescoping tubular shaft 104 is shown in its fully extended position (the upper portion 152 is fully extended from the lower portion 150) and a tubular extender 158 is attached to the lower portion 150.

Figure 18:
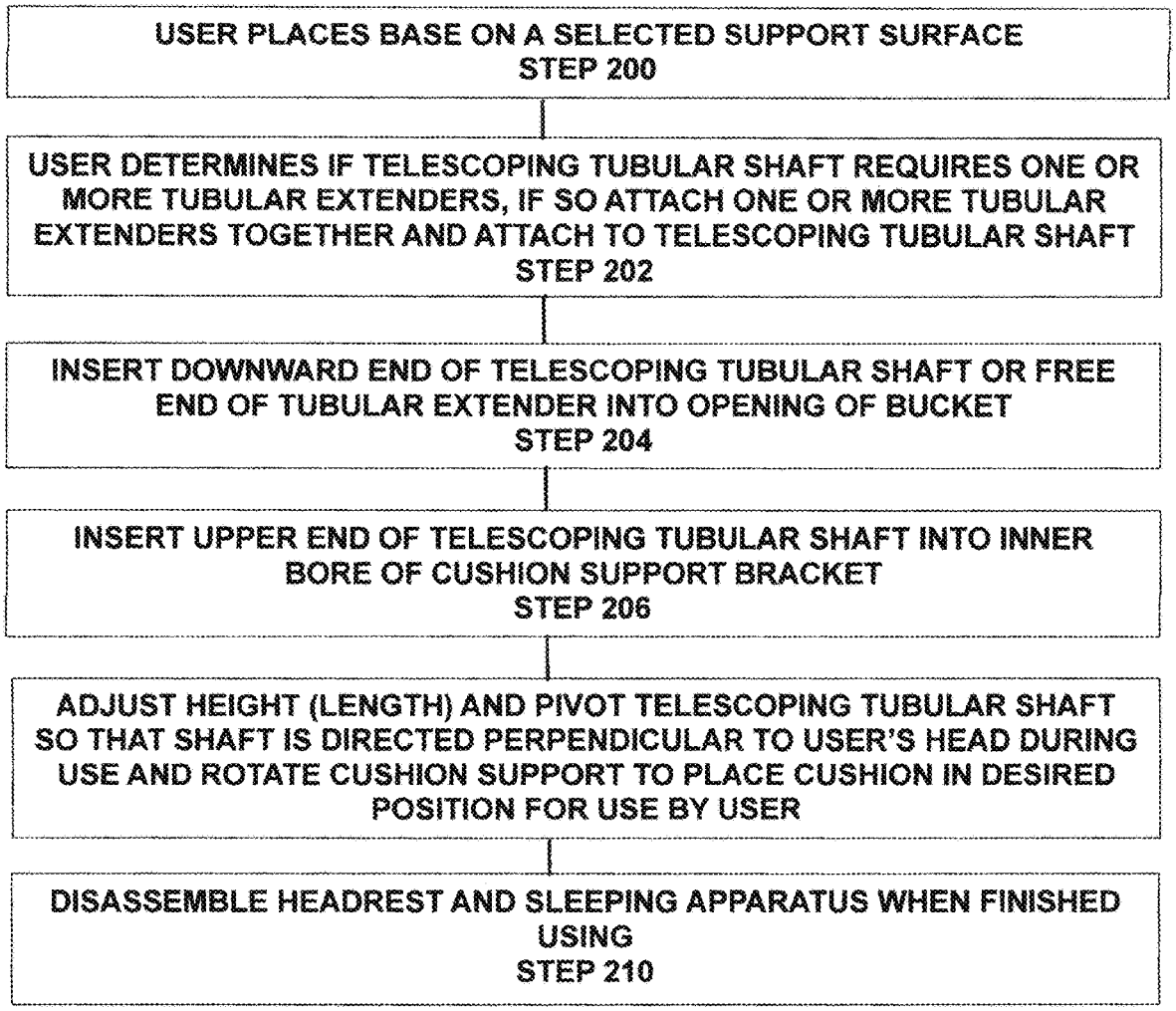
FIG. 18 is a flowchart illustrating a method of assembly, use and disassembly of the headrest and sleeping apparatus.
Figure 19:
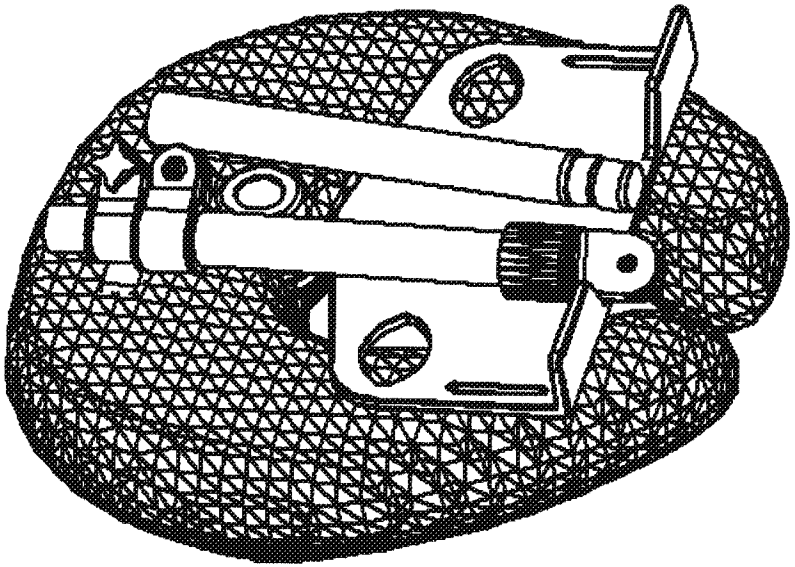
FIG. 19 is a schematic illustration showing the headrest and sleeping apparatus is its disassembled configuration.

Referring to FIG. 18, the headrest and sleeping apparatus is shown such that the various components are disassembled for transporting to a seat that is to be used by a user during travel in a plurality of individual components. Referring to FIG. 19, once the user is at the place of use, the user places the base on a selected support surface (Step 200). The user then determines if the telescoping tubular shaft will require a tubular extender, depending of the location of the support surface, and if so, the user attaches the desired tubular extender to the downward end of the telescoping tubular shaft (Step 202). Once the user decides if the telescoping tubular shaft does or does not require a tubular extender, the user inserts the downward end or the free end of the tubular extender into bucket pivotally coupled to the base (Step 204). The user then inserts the upper end of the telescoping tubular shaft into the inner bore of the cushion support bracket (Step 206). The user then adjusts the height (length) and pivots the telescoping tubular shaft and rotates the cushion support such that the cushion is properly and comfortably in position for the user to bend forward towards the headrest and sleeping apparatus such that the front of the user's head is located in the opening of the cushion and the user's forehead and cheeks rests upon the cushion (or cushion covering) (Step 208). It should be understood that the telescoping tubular shaft of the headrest and sleeping apparatus is perpendicular to the cushion support and cushion thereby operating such that the weight (pressure) of the user's head is transmitted directly to the base and ensures that the telescoping tubular shaft remains in the bucket and the inner bore of the cushion support bracket. When the user stops using the headrest and sleeping apparatus, the user disassembles (FIG. 19) the apparatus by reversing the steps above for assembling the apparatus (Step 210).

Accordingly, a preferred embodiment of the invention is a method for providing head support when traveling comprising the steps of: placing a base having a pivotable bucket with an opening on a selected support surface; adjusting the length of a telescoping tubular shaft to a desired length; placing a downward end of the telescoping tubular shaft into the opening; placing the upward end of the telescoping tubular shaft into an inner bore of a cushion support bracket that is securely attached to a cushion support having a cushion; and pivoting the telescoping tubular shaft and rotating the cushion support to place the cushion in a desired position. In a preferred embodiment the method further comprises the step of attaching a tubular extender to the telescoping tubular shaft. In another preferred embodiment the method further comprises the step of attaching a removable washable, antimicrobial cloth over an upper surface of the cushion.

In view of the foregoing and as has been illustrated, in a preferred embodiment of the headrest and sleeping apparatus for use by a user comprises a base having an upper surface and a lower surface and is pivotally coupled to a bucket having an opening; a cushion support having an upper surface and a lower surface and a bracket with an inner bore coupled to the lower surface of the cushion support; a telescoping tubular shaft having a downward end freely set within the opening of the bucket and having an upward end positioned within the inner bore of the bracket; and a cushion positioned along the upper surface of the cushion support. In a preferred embodiment of the invention the base has a downwardly extending lip. In another preferred embodiment of the invention the headrest and sleeping apparatus further comprises a surface material pad attached to the lower surface of the base. In a preferred embodiment of the invention the base includes a base extender. In a preferred embodiment of the invention the telescoping tubular shaft is attached to a tubular extender. In a preferred embodiment of the invention the cushion has an upper surface and a washable cloth covering the upper surface of said cushion. In a preferred embodiment of the invention the cushion has an upper surface and a removable washable, antimicrobial cloth covering the upper surface of said cushion. In a preferred embodiment of the invention the length of the telescoping tubular shaft is fully adjustable and maintained in length from a minimum tubular length to a maximum tubular length and to any intermediate tubular length. Another preferred embodiment of the invention, the headrest and sleeping apparatus comprises a base having an upper surface and a lower surface and the base is pivotally coupled to a bucket having an opening; a cushion support having an upper surface and a lower surface and a bracket with an inner bore coupled to the lower surface of the cushion support; a telescoping tubular shaft having a downward end freely set within the opening of the bucket and having an upward end freely positioned within the inner bore of the bracket; and a cushion positioned along the upper surface of the cushion support; wherein the length of the telescoping tubular shaft is fully adjustable and maintained in length from a minimum tubular length to a maximum tubular length and to any intermediate tubular length; and wherein the base has a position securing device for maintaining the base in position of the support surface. In a preferred embodiment of the invention the position securing device is a downwardly extending lip. In a preferred embodiment of the invention the position securing device is a non-slip surface material pad attached to the lower surface of the base. Accordingly, it should now be apparent that the headrest and sleeping apparatus of the subject invention has relatively few components thereby making the headrest relatively light weight and inexpensive to manufacture, can be easily carried and stored, can be easily set-up for use, can be placed on various support surfaces, such as a tray, seat or floor, that can be adjusted to properly position the cushion for use by the user, it does not result or reduces neck and/or back pain, it can be used with reduced spacing between the user's seat and the seat in front of the user, and is designed to minimize wear and tear of the components. Thus, the headrest and sleeping apparatus of the subject invention is sleek, ergonomic, portable and can provide full head support allowing a user to rest and sleep during travel and can also be used to provide both head support and leg restraint during use. It should also now be apparent that by angling the telescoping shaft so that it is perpendicular to the cushion support operates such that the entire force (weight) being directed against the cushion by the user's head resting on the cushion is transferred to the base thereby eliminating the need for extra supports and allows the headrest and sleeping apparatus to be constructed of light weight components and reducing the entire weight of the apparatus. Further, it should now be apparent that by angling the telescoping support shaft rearwardly towards the user, allows the apparatus to not interfere with the seat back in front of the use, particular when the distance between the back of the seat and the seat used by the user is narrow as is often the case in many aircraft.

The invention claimed is:

1. A headrest and sleeping apparatus for use by a user comprising:

a base having an upper surface and a lower surface for resting on a support surface and said upper surface of said base is pivotally coupled to a bucket, wherein said bucket having an opening;

a cushion support having an upper surface and a lower surface and a cushion support bracket with an inner bore wherein said cushion support bracket is fixed in position to said lower surface of said cushion support;

a telescoping tubular shaft having a downward end freely nested within said opening of said bucket such that said downward end can rotate within said opening and said telescoping tubular shaft having an upward end positioned within said inner bore of said cushion support bracket, wherein said upper end forms a frictional fit connection with said cushion support bracket such that said upper end can rotate within said inner bore of said cushion support bracket and said downward end of said telescoping tubular shaft can rotate within said bucket thereby rotating said cushion support; and a cushion positioned along said upper surface of said cushion support;

wherein said base includes at least one vertically downwardly extending lip(s) configured to prevent or reduce movement of the said base along the support surface.

2. The headrest and sleeping apparatus of claim 1, wherein the support surface is a tray and wherein said at least one vertically downwardly extending lip(s) is sized to engage with a side of the tray.

3. The headrest and sleeping apparatus of claim 1, further comprising a surface material pad attached to said lower surface of said base.

4. The headrest and sleeping apparatus of claim 1, wherein said base includes a base extender.

5. The headrest and sleeping apparatus of claim 1, wherein said one or more vertically downwardly extending lip(s) are positioned along a longitudinally extending side of said base.

6. The headrest and sleeping apparatus of claim 1, wherein said telescoping tubular shaft is attached to a tubular extender.

7. The headrest and sleeping apparatus of claim 1, wherein said cushion having an upper surface and a washable cloth covering said upper surface of said cushion.

8. The headrest and sleeping apparatus of claim 1, wherein said cushion having an upper surface and a removable washable, antimicrobial cloth covering said upper surface of said cushion.

9. The headset and sleeping apparatus of claim 1, wherein the length of said telescoping tubular shaft is fully adjustable and maintained in length from a minimum tubular length to a maximum tubular length and to any intermediate tubular length.

10. A headrest and sleeping apparatus for position on a support surface for use by a user comprising:

a base having an upper surface and a lower surface and said upper surface of said base includes a hinge assembly is pivotally coupled to a bucket, wherein said bucket includes an opening;

a cushion support having an upper surface and a lower surface and a cushion support bracket with an inner bore coupled to said lower surface of said cushion support such that said cushion support bracket is fixed in position to said lower surface of said cushion support;

a telescoping tubular shaft having a downward end rotatably and freely nested within said opening of said bucket and having an upward end rotatably positioned within and frictionally coupled to said inner bore of said cushion support bracket; and a cushion positioned along said upper surface of said cushion support;

wherein the length of said telescoping tubular shaft is adjustable in length from a minimum tubular length to a maximum tubular length and to any intermediate tubular length; and wherein said base has a position securing device in the form of one or more vertically downwardly extending lips(s) that interacts with the support surface for maintaining said base in position of the support surface.

11. The headrest and sleeping apparatus of claim 10, wherein said lower surface of said base includes a surface material pad that increases surface friction between said base and the support surface.

12. The headrest and sleeping apparatus of claim 11, wherein said surface material pad is removably attached to said lower surface of said base.

13. The headrest and sleeping apparatus of claim 10, further comprising a tubular extender removably attached to said telescoping tubular shaft for extending the length of said telescoping tubular shaft.

14. The headrest and sleeping apparatus of claim 10, wherein said base includes a base extender.

15. The headrest and sleeping apparatus of claim 10, wherein said telescoping tubular shaft is attached to a tubular extender.

16. The headrest and sleeping apparatus of claim 10 having a flexible strap attached to said base.

* * * * *